US005727357A

United States Patent [19]

Arumugasaamy et al.

[11] Patent Number: 5,727,357

[45] Date of Patent: Mar. 17, 1998

[54] COMPOSITE REINFORCEMENT

[75] Inventors: Panchadsaram Arumugasaamy; Mark E. Greenwood, both of Granville, Ohio

[73] Assignee: Owens-Corning Fiberglas Technology, Inc., Summit, Ill.

[21] Appl. No.: 653,953

[22] Filed: May 22, 1996

[51] Int. Cl.[6] ..... E04C 5/07

[52] U.S. Cl. ..... 52/740.1; 52/309.1; 52/309.15; 52/740.3; 52/DIG. 7; 57/232; 428/377

[58] Field of Search ..... 52/309.1, 309.13, 52/309.14, 309.15, 740.1, 740.2, 740.3, 740.4, 740.5, 740.6, 740.7, 740.8, 740.9, DIG. 7; 57/232; 428/377

[56] References Cited

U.S. PATENT DOCUMENTS

| | | | |
|---|---|---|---|
| 2,425,883 | 8/1947 | Jackson | 52/740.8 X |
| 3,895,896 | 7/1975 | White et al. . | |
| 3,993,726 | 11/1976 | Mover . | |
| 4,016,714 | 4/1977 | Crandall et al. | 57/234 |
| 4,079,165 | 3/1978 | Morley | 52/740.9 X |
| 4,168,194 | 9/1979 | Stiles . | |
| 4,296,060 | 10/1981 | Killmeyer et al. . | |
| 4,318,948 | 3/1982 | Hodgson . | |
| 4,555,113 | 11/1985 | Shimazaki et al. . | |
| 4,620,401 | 11/1986 | L'Espérance et al. | 52/740.5 X |
| 4,681,722 | 7/1987 | Carter et al. . | |
| 4,958,961 | 9/1990 | Herbst et al. | 52/740.5 X |
| 5,110,644 | 5/1992 | Sparks et al. . | |
| 5,304,421 | 4/1994 | Lamy et al. . | |
| 5,580,642 | 12/1996 | Okamoto et al. | 52/740.1 X |
| 5,613,334 | 3/1997 | Petrina | 52/740.1 X |

OTHER PUBLICATIONS

Dr. Panchy A. Samy, P.E. and Mark Greenwood Modified Glass and Hybrid Glass/Carbon Fiber Reinforced Plastic (MGFRP & G/CFRP Reinforcement For Concentrate in Marine and Aggressive Environments (Jul. 22, 1994).

*Primary Examiner*—Carl D. Friedman
*Assistant Examiner*—Kevin D. Wilkens
*Attorney, Agent, or Firm*—C. Michael Gegenheimer; Inger H. Eckert

[57] ABSTRACT

Composite reinforcements (100, 100A, 100B, 100C) are formed by combining a first plurality of continuous fibers (102) with a second plurality of continuous fibers (106) with the first and second pluralities of continuous fibers (102, 106) being impregnated with at least one appropriate resin material (R1, R2, R3) and pultruded to form the reinforcements. The first and second pluralities of continuous fibers (102, 106) can be intermixed with one another or combined as a central core (104, 132) of the first fibers with a jacket (108, 108A, 108B, 134) formed by the second fibers. In either event, the combined fibers are formed as an elongated rod (110) and rigidified using the resin material. The first fibers are glass, either E-glass or S-2 glass, with the second fibers being either carbon, aramid, S-2 glass or AR-glass. The composite reinforcements of the present application, formed by combining these materials, have characteristics very similar to steel under tensile loading but with superior corrosion resistance and less detrimental deterioration characteristics.

21 Claims, 5 Drawing Sheets

COMPOSITE REINFORCEMENT

TECHNICAL FIELD

This invention relates to reinforcement materials for use in the construction industry and, more particularly, to reinforcement materials made as a composite of a first plurality of continuous fibers which are combined with a second plurality of continuous fibers. The first and second pluralities of continuous fibers can be intermixed with one another or combined as a central core of the first fibers with a jacket formed by the second fibers. In either event, the combined fibers are formed as an elongated bar or rod and rigidified using resin material. The terms bar and rod as used herein should be considered substantially equivalent and interchangeable to indicate a generally elongated, slender structure.

BACKGROUND OF THE INVENTION

Steel reinforcing bars are used throughout the construction industry. Such bars are most commonly used for reinforcing concrete used in many building applications, with the concrete being reinforced with steel reinforcing bars and/or wire meshes. The reinforcing bars are wired together to form the frameworks or skeletons for building columns and floors in concrete structures. In addition to such static reinforcements, steel wires or cables are heavily loaded to compress concrete in concrete slabs and the like to reduce or eliminate cracking and tensile forces with the wires or cables being pre-tensioned or post-tensioned depending upon the application. Steel wire or cable tensioning can also be applied to wood structures, for example for post-tensioning of wood decks for bridges.

Unfortunately, steel reinforcing bars or rods and tensioning wires or cables are subject to corrosion over time which deteriorates these reinforcing materials and thereby the structures which include them. While deterioration can occur even in the most protected environments, it is common and costly in harsh environments such as structures erected in a marine environment and in slabs used for automobile traffic or parking in climates where salt is applied to roads and bridge decks to control snow and icing conditions. Deterioration of reinforcing bars or rods and tensioning wires or cables usually requires replacement of the associated structure or significant repair. In either event, correction of the deteriorated reinforcing bars or rods and tensioning wires or cables is costly.

There is, thus, a need for improved, deterioration-resistant reinforcements to be used in place of steel reinforcing bars or rods and tensioning wires or cables in the construction industry. Preferably, such improved reinforcements would be used as direct replacements for existing steel reinforcing bars or rods and tensioning wires or cables, and would improve the life expectancy of reinforced structures particularly where such structures are erected in harsh environments including, for example, marine installations.

DISCLOSURE OF INVENTION

This need is met by the invention of the present application wherein composite reinforcements are formed by combining a first plurality of continuous fibers with a second plurality of continuous fibers with the first and second pluralities of continuous fibers being impregnated with at least one appropriate resin material and pultruded or otherwise processed to form the reinforcements. The first and second pluralities of continuous fibers can be intermixed with one another or combined as a central core of the first fibers with a jacket formed by the second fibers. In either event, the combined fibers are formed as an elongated bar or rod and rigidified using resin material. The first fibers are glass, either E-glass or S-2 glass, with the second fibers being either carbon, aramid, S-2 glass or AR-glass (alkaline resistant). The composite reinforcements of the present application, formed by combining these materials, have characteristics very similar to steel under tensile loading but with superior corrosion resistance and less detrimental deterioration characteristics. The superior characteristics are due to the protection afforded by the resin material when the fibers are intermixed, and in addition by the shielding effects afforded by the jacket of impregnated second fibers when a core/jacket configuration is used. In this regard it is noted that composites made from carbon, aramid, S-2 glass and AR-glass together with the resin materials are substantially immune to the corrosive environments which are the cause of corrosion and deterioration of conventional reinforcement materials used in the construction industry.

In accordance with one aspect of the present invention, a composite reinforcement for use in construction comprises a first plurality of continuous fibers with a second plurality of continuous fibers being associated with the first plurality of continuous fibers. Resin material impregnates the first and second pluralities of continuous fibers which are formed into an elongated rod and rigidified by the resin material. In one embodiment of the invention, the first and second pluralities of continuous fibers are intermixed with one another. In another embodiment of the invention, the first plurality of continuous fibers comprises a core and the second plurality of continuous fibers comprises a jacket formed about the core. To help secure the composite reinforcement within material being reinforced, the jacket may be formed to have a textured surface.

The first plurality of continuous fibers comprises glass fibers, for example E-glass or S-2 glass, and the second plurality of continuous fibers comprises fibers having a higher modulus of elasticity and a different ultimate strain than the first plurality of fibers. The combination of high modulus and low modulus fibers and the different failure strains results in a composite reinforcement which exhibits pseudo-ductile behavior. When stressed beyond its initial point of failure, a material that is pseudo-ductile will continue to carry a load but with a significant loss in stiffness. Accordingly, the pseudo-ductile failure mode is very desirable for structural materials and reinforcements for structural materials. The second plurality of fibers may comprise, for example, carbon fibers, aramid fibers, S-2 glass or AR-glass.

In accordance with another aspect of the present invention, a composite reinforcement for use in construction comprises a core of continuous glass fibers with a continuous carbon fiber jacket formed about the core. At least one resin material impregnates the core and the carbon jacket. In one form of the invention, a first resin impregnates the core and a second resin impregnates the continuous carbon fiber jacket. The composite reinforcement may be circular in cross section, elliptical in cross section or have other geometric shapes as a cross section. The composite reinforcement may be formed to have a textured surface to help secure the composite reinforcement within material being reinforced. The at least one resin material may comprise a thermosetting resin or a thermoplastic resin. The composite reinforcement includes a cross-sectional dimension which ranges from approximately 0.125 inch to 1.5 inch. The carbon fiber jacket may comprise continuous carbon fibers over-wrapped and knitted about the core with the continuous carbon fibers being knitted about the core at an angle between 0° and 90°. A volume fraction of glass fibers plus carbon fibers to the resin material ranges from about 0.40 to 0.85, i.e., the percentage of the glass fibers plus the carbon fibers to the at least one resin material ranges from about 40% to 85%.

It is, thus, an object of the present invention to provide improved reinforcements for use in the construction industry wherein a first plurality of continuous fibers is combined with a second plurality of continuous fibers with the first and second pluralities of continuous fibers being impregnated with at least one resin material and processed, for example by pultrusion and solidification or curing, to form the reinforcements.

Other objects and advantages of the invention will be apparent from the following description, the accompanying drawings and the appended claims.

MODES FOR CARRYING OUT THE INVENTION

Composite reinforcements in accordance with the present invention and methods of making the reinforcements will now be described with reference to the drawings. The composite reinforcements are for use in the construction industry for providing more corrosion resistance than steel reinforcing bars or rods and tensioning wires or cables. The composite reinforcements may also be used in other related applications including energy efficient sandwich panels and walls as well as other applications which will be suggested to those skilled in the art by the following description.

Figure 1:
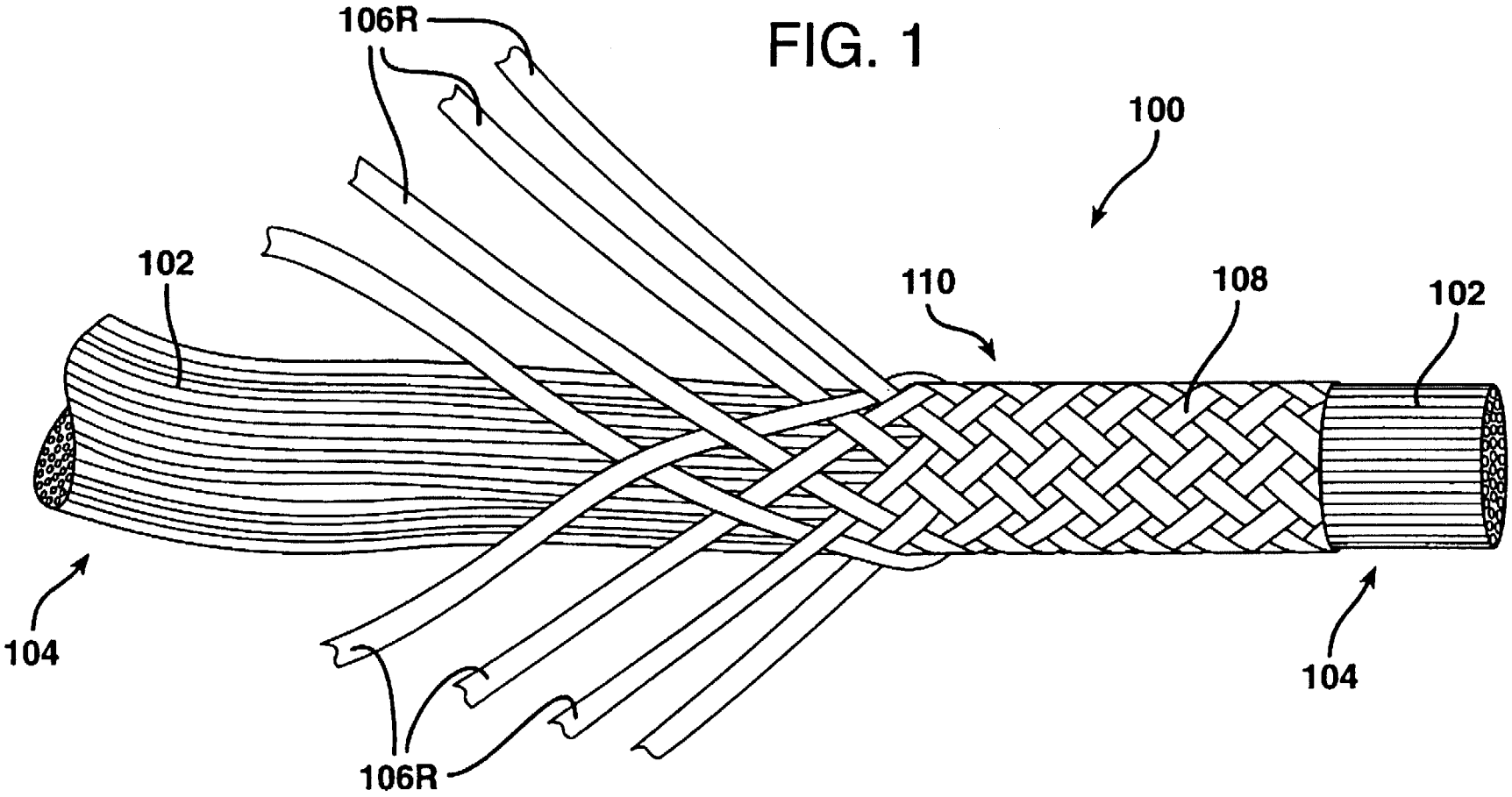
FIG. 1 is a perspective view of a portion of a first embodiment of a composite reinforcement in accordance with the present invention wherein an inner core is over-wrapped by a knitted jacket.
Figure 4D:
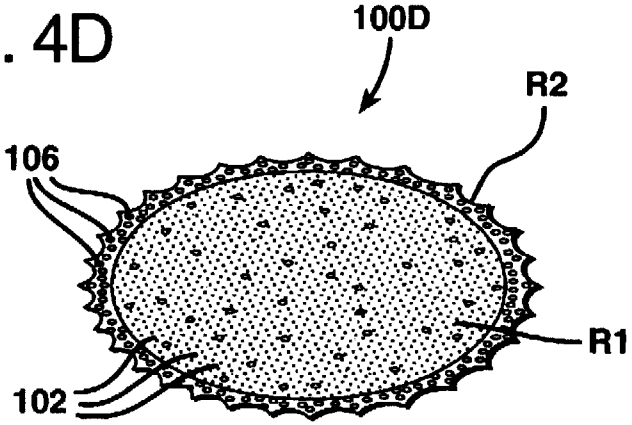
FIG. 4D is a sectional view of an embodiment of a composite reinforcement in accordance with the present invention having an elliptical cross section.

FIG. 1 illustrates a portion of a first embodiment of a composite reinforcement 100 which comprises a first plurality of continuous fibers 102 which have been formed into a core 104. The first plurality of continuous fibers 102 is impregnated with an appropriate thermoplastic or thermosetting resin material R1, as will be described more fully with regard to making the reinforcements, and at least partially solidified or cured to form the core 104. As illustrated, the composite reinforcements are circular; however, the reinforcements can also be elliptical or have other geometric cross sections as should be apparent, for example see FIG. 4D which illustrates a composite reinforcement 100D having an elliptical cross section. The first plurality of continuous fibers 102 may be made up of E-glass fibers for most applications; however, other glass fibers such as S-2 glass fibers and alkaline resistant AR-glass fibers can also be used.

A second plurality of continuous fibers 102, woven or otherwise formed into ribbons 106R for the embodiment of FIG. 1, is associated with the first plurality of continuous fibers 102. As illustrated, the ribbons 106R are knitted to form a jacket 108 over-wrapped about the core 104 and thereby are associated with the first plurality of continuous fibers 102. The second plurality of continuous fibers 106, i.e., the jacket 108, is impregnated with an appropriate thermoplastic or thermosetting resin material R2, which can be the same as or different than the resin material R1 of the core 104, with the entire resulting composite reinforcement being formed into an elongated rod 110 and the resin material solidified or cured to rigidify the composite reinforcement 100.

Figure 2:
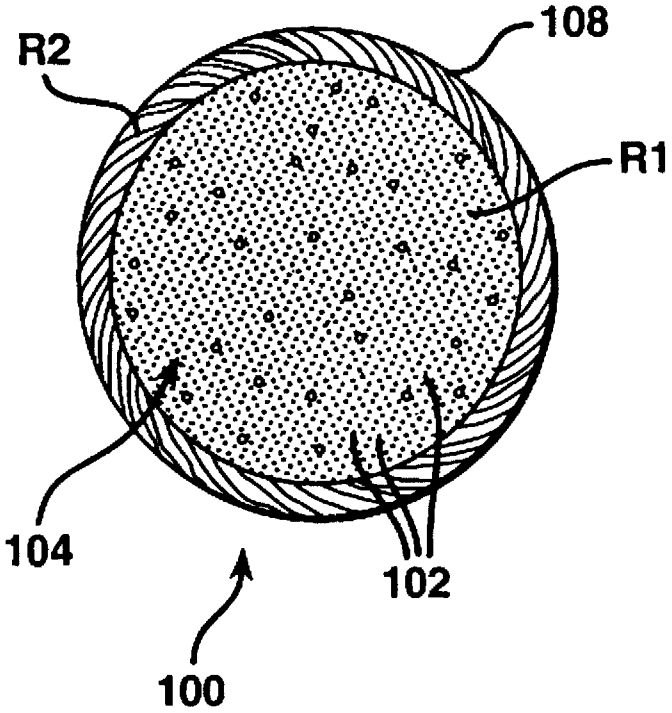
FIG. 2 is a sectional view of the composite reinforcement of FIG. 1.

The first embodiment of FIG. 1 is also shown in cross section in FIG. 2. The second plurality of continuous fibers may be made up of continuous carbon fibers for most applications; however, other fibers, such as S-2 glass, AR-glass and aramid fibers can also be used. It is advantageous to use such fibers, particularly as a jacket, for composite reinforcements since they, as well as the resin materials which are used to impregnate them, are substantially immune to corrosive environments including saline and acidic environments which are the primary cause of corrosion and deterioration in conventional steel reinforcement materials used in the construction industry. Preferably, the core 104 makes up from about 99% to 50% of the cross sectional area of the composite reinforcement 100 with the jacket 108 complementing the core 104 by making up from about 1% to 50% of the cross sectional area of the composite reinforcement 100.

Figure 3:
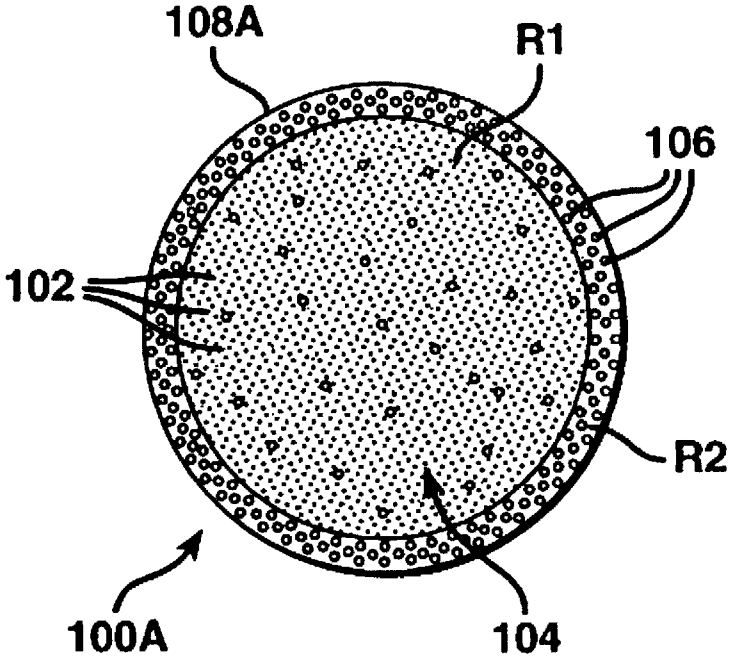
FIG. 3 is a sectional view of a first alternate embodiment of a composite reinforcement of the present invention wherein an inner core of first parallel fibers and resin material is over-wrapped by a jacket of second parallel fibers and resin material.

FIG. 3 illustrates a sectional view of a first alternate embodiment of a composite reinforcement 100A of the present invention wherein the inner core 104 of the first plurality of parallel fibers 102 and resin material R1 is over-wrapped by a jacket 108A formed by a second plurality of parallel fibers 106 and resin material R2. The composite reinforcement 100A of FIG. 3 is similar to the composite reinforcement 100 of FIGS. 1 and 2 except for the formation of the jacket 108A by the second plurality of parallel fibers 106. Due to the structure of the jacket 108A, the composite reinforcement 100A may be formed without initial formation of the core 104 and, hence, may be formed more easily than the composite reinforcement 100 of FIGS. 1 and 2.

Figure 4:
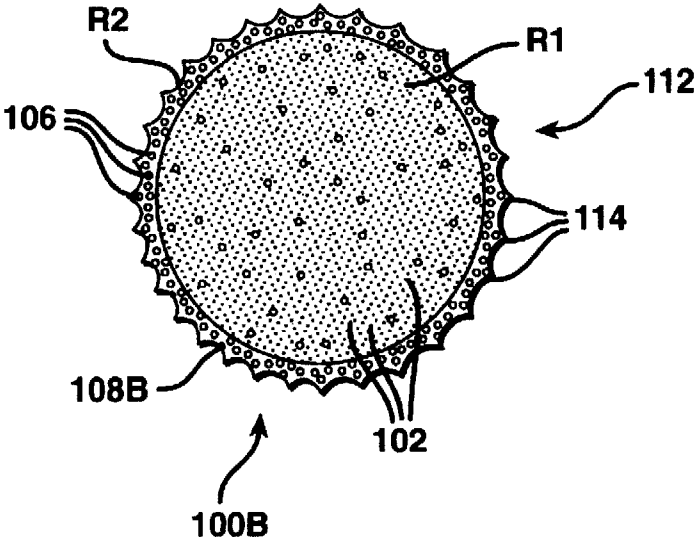
FIG. 4 is a sectional view of a second alternate embodiment of a composite reinforcement of the present invention wherein an inner core of first parallel fibers and resin material is over-wrapped by a jacket of second parallel fibers and resin material with the outer surface of the jacket being formed to define a textured surface.

The embodiment of FIG. 3 can be altered by modification of the pultrusion method used to form a composite reinforcement 100B such that a textured surface 112 is formed on the outside of the jacket 108B, see FIG. 4. The resulting composite reinforcement 100B has ridges 114 which run axially along the composite reinforcement 100B and help secure the composite reinforcement 100B within material which it is being used to reinforced.

Figure 4A:
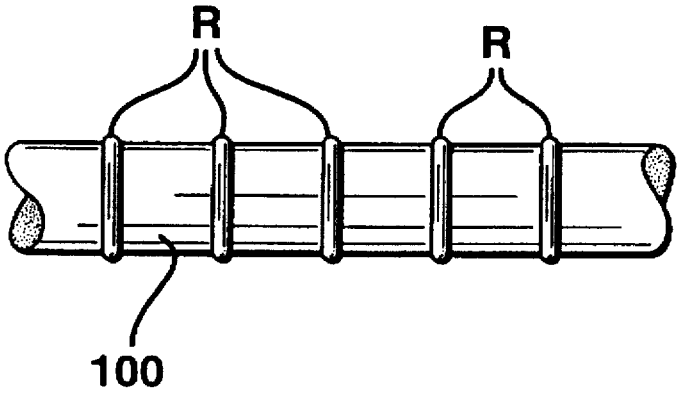
FIGS. 4A, 4B and 4C illustrate circumferential ribs, spiral ribs and criss-crossed ribs, respectively, formed on composite reinforcement in accordance with the present invention.
Figure 4B:
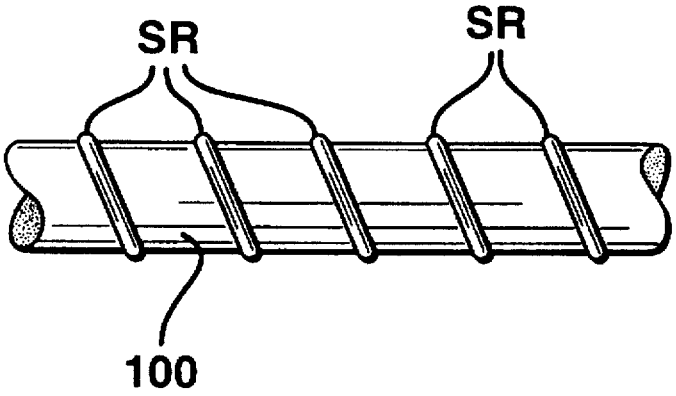
Figure 4C:
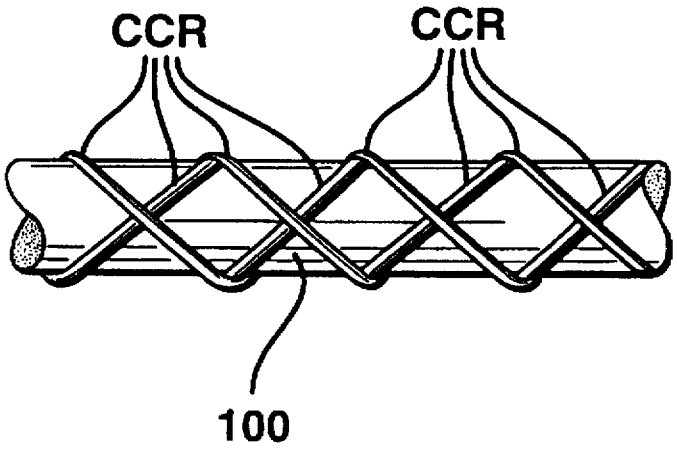

Other surface textures can be formed into the outer surfaces of composite reinforcements of the present invention either by modifying the cross section of the pultrusion die used to form the composite reinforcement or by subsequent operations. For example, regular or randomly formed patterns of protrusions can be formed on the outer surface of composite reinforcements by adding additional fibers and/or resin material on the reinforcements by a post processing station 116, see FIG. 6. FIGS. 4A–4C illustrate circumferential ribs R formed on the composite reinforcement 100, spiral ribs SR formed on the composite reinforcement 100 and criss-crossed ribs CCR formed on the composite reinforcement 100. Of course, other patterns of protrusions will be apparent from the description of the present application. While such subsequent forming operations add to production time and costs, it results in reinforcements which may be better secured within a reinforced material and, with respect to reinforcing bars, more closely resembling conventional steel reinforcing bars.

Figure 5:
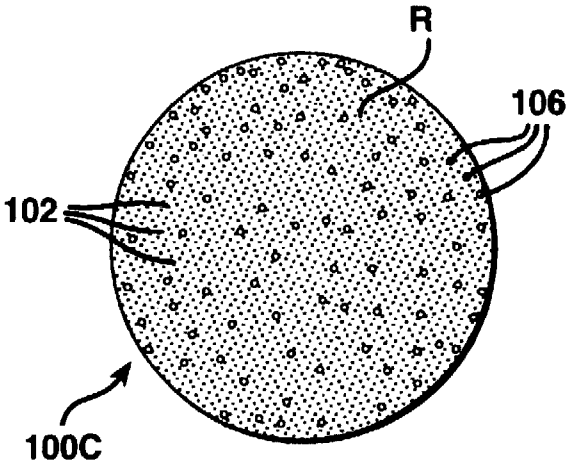
FIG. 5 is a third alternate embodiment of a composite reinforcement of the present invention wherein first and second pluralities of continuous fibers are intermixed with one another and resin material.

A third alternate embodiment of a composite reinforcement 100C is illustrated in FIG. 5 wherein the first plurality of continuous fibers 102 are intermixed with the second plurality of continuous fibers 106. It is currently believed that a random intermixing of the first and second pluralities of continuous fibers 102, 106 as illustrated is preferred; however, patterns of mixing can be used in the present invention. The first and second pluralities of continuous fibers are impregnated with an appropriate thermoplastic or thermosetting resin material R and formed into an elongated rod and solidified or cured to rigidify the composite reinforcement 100C.

Formation of the composite reinforcement 100C is, thus, more simple than the formation of the composite reinforcements 100, 100A and **100*b* since the jacket of those embodiments has been incorporated into the structure of the composite reinforcement 100C by intermixing the first and second pluralities of continuous fibers 102, 106**. It is currently believed that composite reinforcements ranging in size from approximately 0.125 inch to 1.50 inches in diameter or maximum cross sectional dimension will be necessary for reinforcement applications. However, other sizes may be made as required.

A significant aspect of the present invention is that the first and second pluralities of continuous fibers have differing moduli of elasticity and differing ultimate strain capacities. The combination of such high modulus and low modulus fibers and the different failure strains results in a composite reinforcement which exhibits pseudo-ductile behavior.

Figure 6:
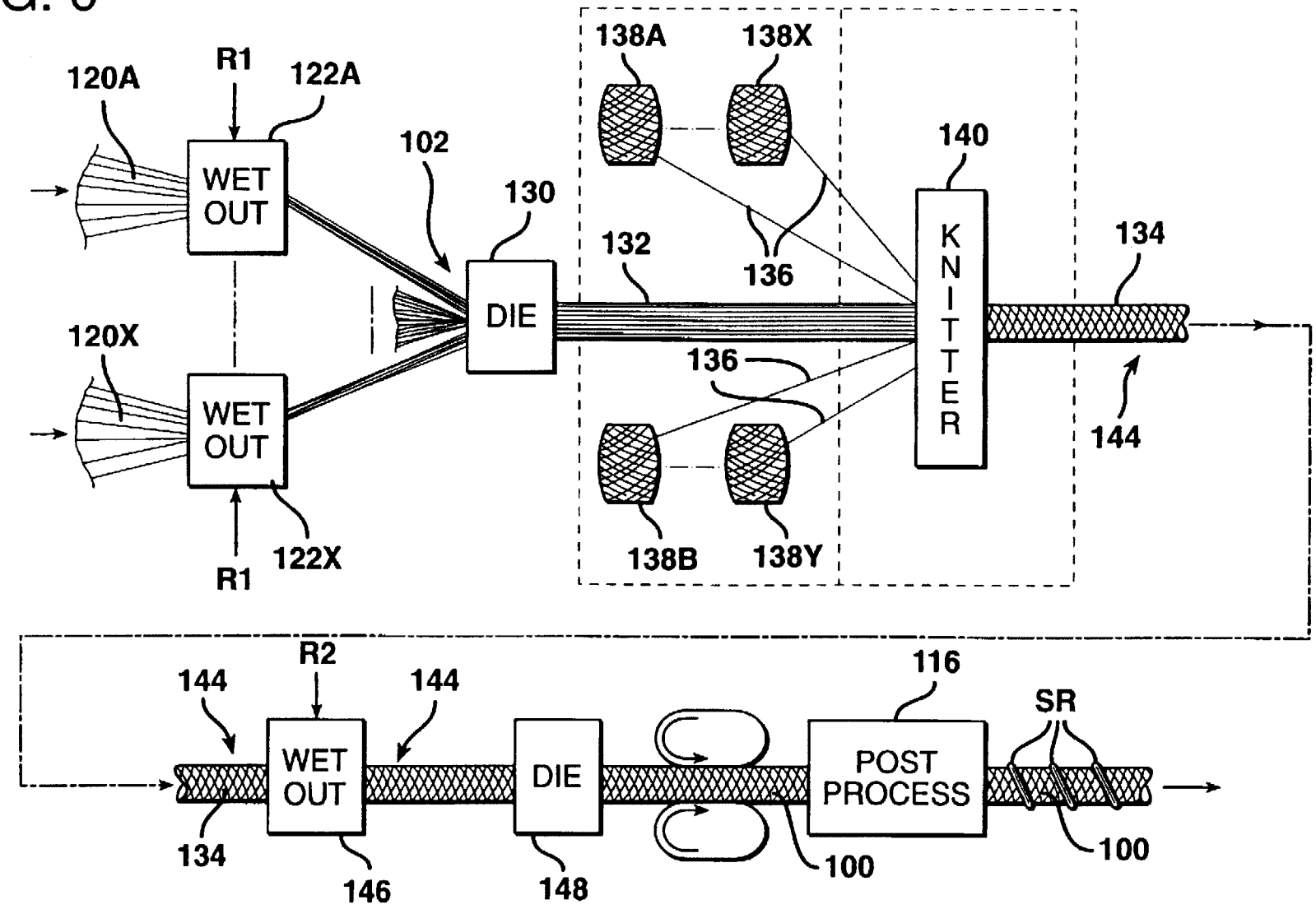
FIG. 6 is a schematic elevational view of apparatus for making composite reinforcements in accordance with the present invention.

With this understanding of the various structures of the composite reinforcements of the present invention, reference will now be made to FIG. 6 for a description of how the composite reinforcements can be made. Since the structure of the composite reinforcement 100 of FIGS. 1 and 2 is more complex than the other alternate embodiments, its production will be described. Modifications for producing the other alternate embodiments described above as well as additional embodiments which will be suggested from this description will be apparent to those skilled in the art.

The first plurality of fibers 102 can be supplied from a single source of such fibers. As shown in FIG. 6, the first plurality of fibers 102 is assembled from a plurality of fiber sources 120A–120X. The first plurality of fibers 102 are drawn through a corresponding number of wet-out stations 122A–122X where the fibers are impregnated with an appropriate resin material R1: a thermoplastic resin material such as a polypropylene, an acrylic, a cellulosic, a polyethylene, a vinyl, a nylon or a fluorocarbon; or, a thermosetting resin material such as an epoxy, a polyester, a vinylester, a malamine, a phenolic or a urea. The impregnated fibers are then passed through a pultrusion die 130 where the impregnated fibers are formed into an elongated core 132. Composite reinforcements can also be formed using extrusion, injection molding, compression molding and other appropriate processes.

Either immediately after production, as illustrated, or at a subsequent time, a jacket 134, such as the jacket 108 of FIGS. 1 and 2, is over-wrapped about the core 132 by knitting ribbons 136 woven or otherwise formed from the second plurality of continuous fibers 106. The ribbons 136 are provided from ribbon sources 138A–138Y, schematically illustrated as spools, which feed a cross-head winder or under-knitter 140. The cross-head winder or under-knitter 140 winds or knits the ribbons 136 as shown in FIG. 1 at a knitting angle typically around 45°; however, the knitting angle can vary between 0° and 90°. By knitting the jacket 108 about the core 132, the core 132 is better encased or enclosed by the jacket 108 to thereby better protect the core 132 from corrosive environments. Cross-head winders and knitters are well known in the art and will not be further described herein.

The ribbons 136 or strands of reinforcing fibers 106 used to form the jacket 108 may be preimpregnated with an appropriate resin R2 or the resulting jacketed core 144 may be drawn through a wet-out station 146 where the jacket 134 is impregnated with an appropriate resin material R2: a thermoplastic resin material or a thermosetting resin material, which can be the same as or different than the resin material R1. The jacketed core 144 with the jacket 134 thus impregnated is then passed through a curing die 148 or otherwise processed. Preferably, the volume percentage of fibers to resin(s) ranges between approximately 40% and 85%.

It is noted that either resin baths or resin injection can be used to saturate the fibers to produce the composite reinforcements of the invention. Accordingly, the wet-out stations 122A–122X and 146 shown in FIG. 6 can be either resin baths or resin injection dies. Since both forms of resin impregnation are well known in the art, they will not be more fully described herein. It should also be apparent that the composite reinforcement 100C of FIG. 5 can be produced by the apparatus up to and including the pultrusion die 130.

Having thus described the invention of the present application in detail and by reference to preferred embodiments thereof, it will be apparent that modifications and variations are possible without departing from the scope of the invention defined in the appended claims.

We claim:

1. A composite reinforcement for use in construction comprising:

a first plurality of continuous fibers forming a core for said composite reinforcement;

a second plurality of continuous fibers associated with said first plurality of continuous fibers and forming a jacket which substantially covers said core; and resin material impregnating said first and second pluralities of continuous fibers which are formed into an elongated rod and rigidified by said resin material.

2. A composite reinforcement as claimed in claim 1 wherein said first plurality of continuous fibers comprise glass fibers and said second plurality of continuous fibers comprise fibers having a higher modulus of elasticity and a different ultimate strain than said first plurality of fibers.

3. A composite reinforcement as claimed in claim 2 wherein said second plurality of continuous fibers comprise carbon fibers.

4. A composite reinforcement as claimed in claim 2 wherein said second plurality of continuous fibers comprise aramid fibers.

5. A composite reinforcement as claimed in claim 1 wherein said jacket is formed to have a textured surface to help secure said composite reinforcement within material being reinforced.

6. A composite reinforcement as claimed in claim 1 wherein said first plurality of continuous fibers comprise E-glass fibers and said second plurality of continuous fibers comprise S-2 glass fibers.

7. A composite reinforcement as claimed in claim 1 wherein said first plurality of continuous fibers comprise E-glass fibers an said second plurality of continuous fibers comprise AR-glass fibers.

8. A composite reinforcement as claimed in claim 1 wherein said first plurality of continuous fibers comprise S-2 glass fibers and said second plurality of continuous fibers comprise fibers selected from the group consisting of carbon fibers and aramid fibers.

9. A composite reinforcement as claimed in claim 1 wherein a first resin (R1) impregnates said first plurality of continuous fibers and a second resin (R2) impregnates said second plurality of continuous fibers.

10. A composite reinforcement for use in construction comprising:

a core of continuous glass fibers;

a continuous carbon fiber jacket formed about and substantially covering said core; and at least one resin material impregnating said core and said carbon jacket.

11. A composite reinforcement as claimed in claim 10 wherein said carbon fiber jacket comprises continuous carbon fibers over-wrapped and knitted about said core.

12. A composite reinforcement as claimed in claim 11 wherein said continuous carbon fibers are knitted about said core at an angle between 0° and 90°.

13. A composite reinforcement as claimed in claim 12 wherein a volume ratio of said glass fibers plus said continuous carbon fibers to said at least one resin material (R, R1, R2) ranges from about 0.4 to 0.85.

14. A composite reinforcement as claimed in claim 10 wherein said composite reinforcement is circular in cross section.

15. A composite reinforcement as claimed in claim 10 wherein said composite reinforcement is elliptical in cross section.

16. A composite reinforcement as claimed in claim 10 wherein said composite reinforcement is formed to have a textured surface to help secure said composite reinforcement within material being reinforced.

17. A composite reinforcement as claimed in claim 10 wherein said at least one resin material (R, R1, R2) comprises a thermosetting resin.

18. A composite reinforcement as claimed in claim 10 wherein said at least one resin material (R, R1, R2) comprises a thermoplastic resin.

19. A composite reinforcement as claimed in claim 10 wherein said composite reinforcement includes a cross-sectional dimension which ranges from approximately 0.125 inch to 1.50 inch.

20. A composite reinforcement as claimed in claim 10 wherein a first resin (R1) impregnates said core and a second resin (R2) impregnates said continuous carbon fiber jacket.

21. A composite reinforcement for use in construction comprising:

a first plurality of continuous fibers having a first strain capacity and forming a core for said composite reinforcement;

a second plurality of continuous fibers having a second strain capacity which is different than said first strain capacity, said second plurality of continuous fibers being associated with said first plurality of continuous fibers by forming a jacket which substantially covers said core; and resin material impregnating said first and second pluralities of continuous fibers which are formed into an elongated rod and rigidified by said resin material to form said composite reinforcement which fails in a pseudo-ductile mode when loaded to failure.

* * * * *